US011274551B2

(12) United States Patent
Weinberger et al.

(10) Patent No.: US 11,274,551 B2
(45) Date of Patent: Mar. 15, 2022

(54) MATERIAL HANDLING APPARATUS FOR A MINING MACHINE

(71) Applicant: SANDVIK MINING AND CONSTRUCTION G.M.B.H., Zeltweg (AT)

(72) Inventors: Gerhard Weinberger, Zeltweg (AT); Helga Schicho, Seckau (AT); Karl Irregger, Weisskirchen (AT)

(73) Assignee: Sandvik Mining and Construction G.m.b.H., Zeltweg (AT)

( * ) Notice: Subject to any disclaimer, the term of this patent is extended or adjusted under 35 U.S.C. 154(b) by 0 days.

(21) Appl. No.: 17/042,238

(22) PCT Filed: Mar. 29, 2018

(86) PCT No.: PCT/EP2018/058235
§ 371 (c)(1),
(2) Date: Sep. 28, 2020

(87) PCT Pub. No.: WO2019/185160
PCT Pub. Date: Oct. 3, 2019

(65) Prior Publication Data

US 2021/0115791 A1 Apr. 22, 2021

(51) Int. Cl.

| | |
|---|---|
| ***E21C 35/20*** | (2006.01) |
| ***E21C 25/10*** | (2006.01) |
| *E21C 35/00* | (2006.01) |
| *E21C 35/02* | (2006.01) |

(52) U.S. Cl.
CPC ..... *E21C 35/20* (2013.01); *E21C 25/10* (2013.01); *E21C 35/00* (2013.01); *E21C 35/02* (2013.01)

(58) Field of Classification Search
CPC ..... E21C 35/20
See application file for complete search history.

(56) References Cited

U.S. PATENT DOCUMENTS 2,753,971 A * 7/1956 Ball ..... E21D 9/126 198/513
3,169,797 A * 2/1965 Lundquist ..... E21C 35/20 299/64
3,620,345 A * 11/1971 Gonski ..... E21D 9/128 198/512

(Continued)

FOREIGN PATENT DOCUMENTS

| | | |
|---|---|---|
| GB | 1498425 A | 1/1978 |
| GB | 2172322 A | 9/1986 |
| GB | 2397313 A | 7/2004 |

*Primary Examiner* — Janine M Kreck
(74) *Attorney, Agent, or Firm* — Corinne R. Gorski

(57) ABSTRACT

A flexible material handling apparatus is arranged to be installed on a full face heading machine. The apparatus includes a material handling member and a linkage member coupled together in a head-tail manner by a joint connection, and the linkage member at the other end may be coupled to a frame of a heading machine. The entire apparatus may be retracted to rest on the side of the machine frame and maintained there by a locking means. The material handling member may be swivelled about two separate vertical axes and brought outwardly to an oblique front position, where one or more locking means may be included to secure the material handling member fixed in place relative to the machine frame.

12 Claims, 8 Drawing Sheets

(56) References Cited

U.S. PATENT DOCUMENTS

| | | | | | |
|---|---|---|---|---|---|
| 3,680,920 | A | * | 8/1972 | Amoroso | E21D 9/128 299/64 |
| 3,966,258 | A | | 6/1976 | Dolecki | |
| 4,047,762 | A | * | 9/1977 | Bamford | E21D 9/128 299/64 |
| 4,296,856 | A | | 10/1981 | Freed | |
| 4,363,519 | A | * | 12/1982 | Howard | E21C 27/28 173/186 |

* cited by examiner

MATERIAL HANDLING APPARATUS FOR A MINING MACHINE

RELATED APPLICATION DATA

This application is a § 371 National Stage Application of PCT International Application No. PCT/EP2018/058235 filed Mar. 29, 2018.

FIELD OF INVENTION

The present invention relates to a material handling apparatus for gathering excavated material lying on the ground. The apparatus is adapted to be arranged on the front side of a heading machine for cutting mines and tunnels, especially on a borer miner for excavating potash or salt mines.

BACKGROUND

In mining industry, a full face heading machine implementing mechanical cutting method is widely used to develop a tunnel at a single cutting pass. The cutting of such a machine does not require additional upwards/downwards movements since the rotating envelop of the cutting tool system corresponds to the cutting profile. When using a full face heading machine, a cutting profile achieved by the cutting system of the machine has a dimension corresponding to the expected tunnel profile size. For economical and/or technical considerations, cutting machines often have a design of limited width, whilst the expected tunnel roadway or lane needs to be much wider. So it is required for the heading machine to perform multiple parallel cutting passes. During the additional cutting pass, the cut-off material may fall outwards on the side of the machine to the adjacent tunnel ground. If the material is left on the ground without being collected, this results in loss of massive excavated ore material, and has serious negative impact on mining efficiency. In order to collect these ore material, additional efforts, for example further collecting operation in terms of extra machine tools/trucks may be needed.

U.S. Pat. No. 4,363,519 describes a drilling machine equipped with mucking arms 26 and plates 31 to help clearing the muck on the ground. Referring to FIG. 4, gathering arms 26 is of substantial box beam construction and are attached to the front extension 25 for pivotal motion in both horizontal and vertical plane by pivots 27 and 28 respectively, actuated by hydraulic cylinders 30 and 29. This document gives no teaching to a full face machine where usually no free space is available beside the cutting tool system for a material handling apparatus. The mucking structure is not able to retract to a parking position where the mucking structure is completely concealed behind the cutting system.

GB2397313 also relates to a drilling machine. It describes a shovel 7 mounted on a retractable mounting 10 for sliding the shovel into the body 8. Similar to U.S. Pat. No. 4,363,519, the machine is not a full face machine, meaning that the body 8 together with the mounting 10 do not work if the cutting tool system has a width corresponding to the cutting profile width (extension operation of shovel 7 must be blocked by the cutting tool system).

SUMMARY

To overcome the above described problem, one solution is to install, before a second or further cutting pass, a temporary plough means that has a fixed structure on the frame of the machine, to assist gathering excavated ore material found on the ground. However, when the machine starts to cut a new lane, or starts a cross cut (for example to cut a connection tunnel), a fresh first cutting pass is to be performed where a plough is not required, the temporary plough means must be detached and removed away, as it extends outward beyond the cutting profile and obstructs the cutting operation. For a subsequent second cutting pass, the temporary plough means shall be re-installed again.

Such frequent mounting and demounting of a temporary plough means during cutting operation is cumbersome and costly. Since the plough means is very heavy and may weigh several tons, extra machines are needed in order to install or demount the plough to/from the machine. This process is time-consuming and results in extensive down-time of the machine operation, thus reduces the cutting performance of the machine. In addition, there is a risk of harming the operators during exposure of the assembly in the mine.

The present invention is aimed at providing a flexible material handling apparatus adapted to be installed on a full face heading machine. The apparatus can be swivelled between a retracted position (called a parking position) and an extended position (called a working position). At the working position, the handling apparatus is situated on the side of the cutting system and extended substantially along or parallel to the longitudinal direction of the machine. Preferably, it extends beyond the forefront of the cutting system. When relocated to the parking position, the apparatus is located behind the cutting system, i.e. it does not extend laterally or transversely beyond the cutting profile of the cutting system. The apparatus is said to be flexible in the sense that it is deformable or movable between a parking position and a working position, and it is not a fixed structure (a fixed structure would require frequent mounting and demounting operation). The apparatus is movable between retracted and extended positions, so it is not necessary to demount it when it is not in use. Thereby valuable operating time is saved and the machine down time is reduced. Also the manpower and extra equipment for mounting/demounting the material handling apparatus is then not required.

It is an objective of the present invention to provide a material handling apparatus that has a set of working positions. This is a requirement for a full face heading machine that is able to cut variable cutting profiles—having different widths and/or heights, for example cut by extendible cutting sections on the cutting drum or rotors. The material handling apparatus is designed such that it may be positioned and locked in one working position selectively from a set of working positions while maintaining its material handling member substantially parallel to the longitudinal direction of the machine (or in a predefined acute angle relative to the longitudinal direction of the machine). This is achievable since the apparatus is configured as a deformable and a flexible structure, instead of a rigid structure. The linkage member serves as a flexible link that permits the material handling member to be positioned at various working positions.

The objective of the invention is achieved by providing a material handling apparatus comprising a material handling member and a linkage member coupled together in a head-tail manner by a joint connection, the linkage member at the other end may be coupled to a frame of a heading machine. The entire apparatus may be retracted to rest on the side of the machine frame, and maintained in that position by certain locking means. In retracted status, the material handling member and the linkage member are folded together, thus the entire apparatus takes less space. Especially having narrower width, the apparatus therefore does not exceed or extend beyond a width that corresponds to a cutting profile or the minimal cutting profile. The material handling member may be swivelled or rotated about at least two separate vertical axes and be brought outwards to an oblique front position, where it has an orientation mainly parallel to the longitudinal direction of the machine. One or more locking means may be included to secure the material handling member fixed in place relative to the machine frame.

According to an aspect of the present invention there is provided a material handling apparatus including: a material handling member for gathering excavated material found on the ground, having a substantially flat under-surface and a height; a linkage member; the material handling member coupled to the linkage member at the distal end thereof by a first joint connection at least allowing the material handling member to rotate about a vertical axis of rotation; the linkage member at its proximal end having at least a part of a joint arrangement for forming a second joint connection with a machine frame, the second joint connection at least allowing the linkage member to rotate about a vertical axis of rotation; a holding means to prevent a movement of the material handling member at a working position in relation to the machine frame. The holding means is configured to be coupled between the material handling member and the machine frame; alternatively, the holding means is configured to be coupled between the linkage member and the machine frame, and between the material handling member and the linkage member.

In one embodiment, the holding means includes a locking assembly arranged on the linkage member, and/or a locking mechanism on the linkage member, and/or a lever system being arranged on opposite ends. It can be a lock catch or a latch or a socket-plug design or the like. It may include various elements to impede the movement between the material handling member, and/or the linkage member and/or the machine frame, or a combination thereof.

Preferably, the material handling apparatus further includes at least one drive means for actuating a movement of the material handling member in a horizontal plane between a parking position and a working position; preferably, the at least one drive means also functions as the holding means, that is, the holding means and the drive means is integrated into an identical unit, the drive means at the working position may be used as holding means to achieve a brake and locking effect. Preferably the drive means includes a hydraulic cylinder, or a chain winch, or a motor, or in combination thereof. A hydraulic cylinder may be controlled by a hydraulic circuit having a solenoid valve, the control of which may be easily integrated into an automation system. A chain winch may be stationarily fixed and its chain may be motorically wound up and off. A motor may be electric/hydraulic powered and preferably include a gear mechanism for reducing the rotation speed, its rotary shaft may be coupled to the material handling member or the linkage member.

Preferably, each of the first joint connection and the second joint connection is a pin pivot or a hinge having a vertical axis of rotation. In this case, the material handling member may be entirely supported and carried on the linkage member. However, it is possible to use other kind of joint connection such as ball joint or universal joint, allowing movement in all direction, in this case, the material handling member may be equipped with wheels or rollers on its side, to transport the weight of the material handling member to the ground.

In one embodiment, the drive means including a first and second arms pivotably attached together at one end of each arm, the other end of the second arm is coupled to the material handling member, the other end of the first arm is configured to be pivotably coupled to the machine frame at a base position departing from the second joint connection, the drive means including an actuator arranged between the first and second arms for providing an angular displacement therebetween. The first and second arms is configured to form a deformable V-shaped structure that can be closed or opened by the actuator.

Optionally the actuator including a hydraulic cylinder, with one end pivotably attached to an intermediate point of the second arm, with the other end pivotably attached to the first arm or the base position. Use a single cylinder to drive the material handling apparatus makes the movement control easier.

In another embodiment, the drive means including a first hydraulic cylinder, wherein one end of the first hydraulic cylinder is pivotably coupled to the linkage member at a position departing from the second joint connection, the other end is configured to be pivotably coupled to the machine frame at a base position departing from the second joint connection; the drive means further including a second hydraulic cylinder, whose one end is pivotably coupled to the distal end of the linkage member, the other end is pivotably coupled to the material handling member at a position remote from the first joint connection.

Preferably, the material handling member including a bracket and a conveying panel, the conveying panel is pivotably attached to the bracket via a pivot connection having a horizontal axis of rotation, the bracket is coupled to the linkage member by a pivot connection having a vertical axis of rotation. The conveying panel may be in the form of reinforced slab, its distal end may be freely raised upwardly when the slab runs onto an uneven ground, or inclined slope, or local ramp, this has the benefit of avoiding a damage to the material handling apparatus by a bump on uneven ground during a cutting process i.e. when the machine advances.

Optionally, the conveying panel includes an upper part and a lower part that is movably coupled to the upper part, and an actuation means that is adapted to lift and lower the lower part relative to the upper part. Such a setup facilitates the relocation of the material handling member between the park and working positions. At the working position the lower part descends to close the gap between the lower part and the ground, thereby to enable efficiently collecting material on the ground; whilst during the relocation, the lower part which has much lighter weight than the upper part is easily lifted up—without the need to lift the entire heavy panel, due to sufficient space being present under lower part, the relocation is thereby not to be blocked by uneven ground.

Optionally, the holding means including a movable member for locking the linkage member at the parking position or at the working position, the movable member being spaced apart from the second joint connection, and having a counterpart being adapted to engage with a complementary part of an extension of the machine frame such that a rotation movement of the linkage member is prevented; preferably the movable member is movable upwardly or downwardly upon actuation by a hydraulic cylinder, preferably the movable member is a pin having a protrusion as the counterpart, and the complementary part is a recess.

The movable member works as a latch which may have a latch recess on it, when the latch recess is aligned with the extension of the machine frame, it allows the linkage member to rotate freely, otherwise it blocks the rotation. The displacement of the movable member within the linkage member may only be allowed by the complementary part or a recess of the extension of the machine frame at certain situations, i.e. when the linkage member is at the parking position or at the working position.

Optionally, the holding means including a movable member for locking the material handling member relative to the linkage member at the parking position or at the working position, the movable member being spaced apart from the first joint connection, and having a counterpart being adapted to engage with a complementary part on an extension of the linkage member such that a rotation movement of the material handling member relative to the linkage member is prevented; preferably the movable member is movable upwardly or downwardly upon actuation by a hydraulic cylinder, preferably the movable member is a pin having a protrusion as the counterpart, and the complementary part is a recess.

According to a further aspect of the present invention, there is provided a mining machine having a machine frame and a cutting tool system mounted on the frame, the mining machine further including a material handling apparatus according to any one of the preceding embodiments, wherein the apparatus is coupled to the machine frame such that, when positioned at a working position, the material handling member is situated on one side of and substantially close to the cutting tool system, and preferably protrudes from the forefront of the cutting tool system. Preferably at the working position the material handling member is positioned substantially parallel to the machine longitudinal direction, it may be configured to tip or tilt outwardly slightly or to an extent. Optionally, the cutting tool system or a part thereof may be mounted on the frame via a gear system.

In one embodiment, the cutting tool system including a bottom cutting drum having transverse horizontal axis of rotation, the cutting drum including a plurality of cutting tools arranged tilted upwardly and/or inwardly and/or in a spiral pattern on the circumference. The cutting tools on the rotating bottom cutting drum help to bring excavated material collected by the material handling apparatus to move towards the machine central area, and further guide and feed the material onto a belt conveyor.

In another embodiment, the cutting tool system including at least one cutting rotor having a longitudinal horizontal axis of rotation, each rotor having at least one rotor arm and a shovel-like means or a loading bucket arranged thereon. The shovel-like means or the loading bucket extending rearwards (opposite to the cutting bits), preferably the shovel-like means or the loading bucket or an additional shovel is extendible and retractable on the rotor arm—for example arranged on an extendible cutting section. Preferably including a plurality of inwardly-tilted cutting tools arranged on the at least one rotor arm. During operation, the rotating rotor arms (the right cutting rotor rotating in clockwise direction, the left cutting rotor rotating in counterclockwise direction, seen from the front, FIG. 1A) under the aid of shovel-like means bring excavated material collected by the material handling apparatus to the machine central area.

While preferred embodiments of the present invention have been illustrated, and described, it will be understood that changes and modifications may be made therein without departing from the invention in its broader aspects.

BRIEF DESCRIPTION OF DRAWINGS

A specific implementation of the present invention will now be described, by way of example only, and with reference to the accompanying drawings in which.

DETAILED DESCRIPTION

Figure 1A:
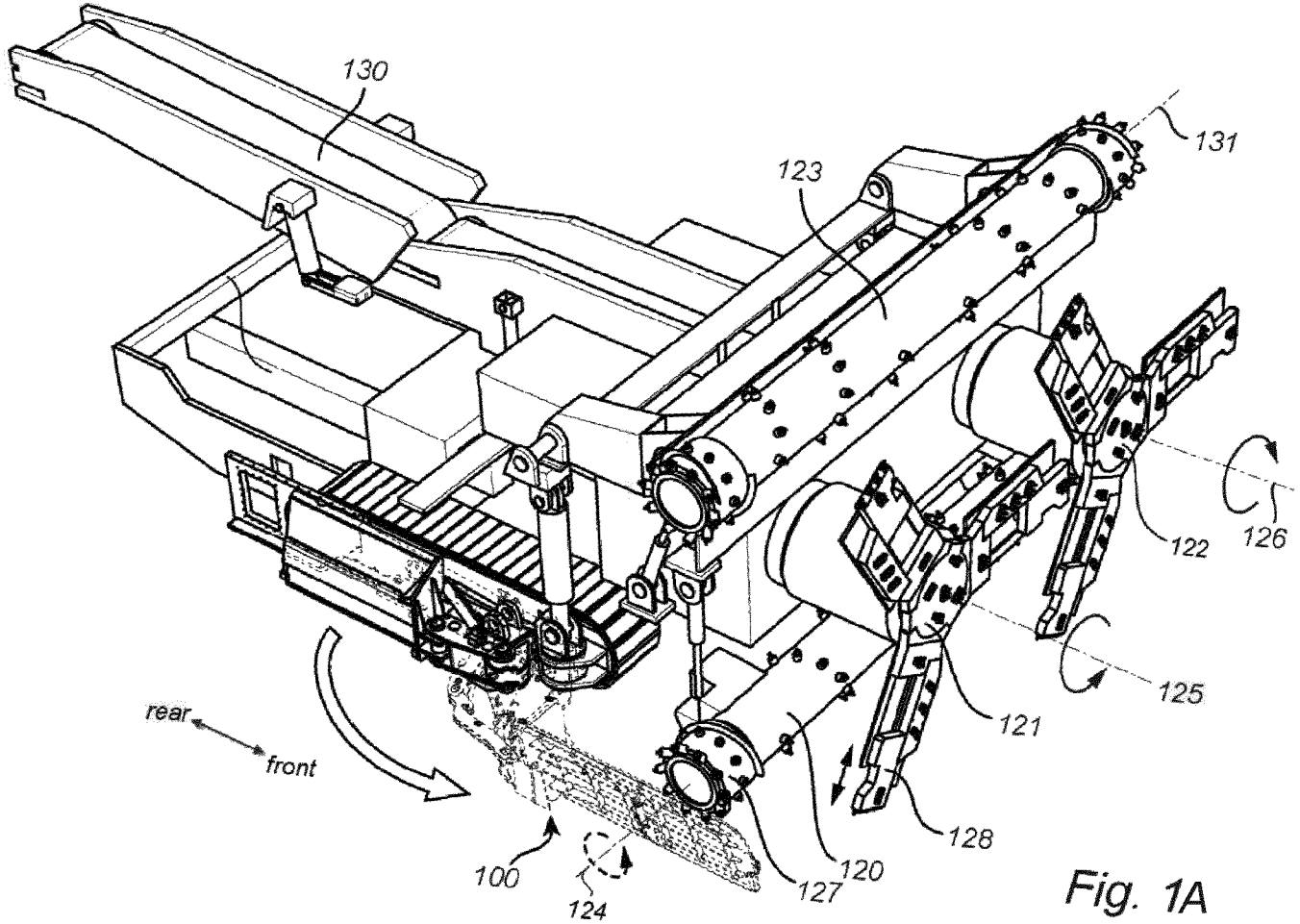
FIG. 1A is a perspective view of a heading machine equipped with a material handling apparatus according to a specific implementation of the present invention.

FIG. 1A shows a heading machine having a cutting system capable of cutting a rectangular cutting profile. The machine is equipped with a material handling apparatus 100 according to a specific implementation of the present invention. The material handling apparatus 100, referred to as a plough, is in its retracted position, and may be swivelled along a direction indicated by the arrow to a working position illustrated by the dashed lines.

The heading machine includes a self-propelled travelling mechanism such as a crawler. The travelling mechanism carries, for example via an undercarriage, a machine frame 114 which bears on it a cutting boom, the boom in turn supports a pair of rotary boring heads or called rotating cutting heads 121 and 122 having a similar construction. The cutting boom can be adjusted in the vertical direction by an appropriate adjusting apparatus e.g. hydraulic cylinders.

The pair of cutting heads 121 and 122 are arranged parallelly side by side on the front of the machine, each having a horizontal axis of rotation 125, 126 substantially aligned with the longitudinal direction of the machine. Each cutting head is a three-armed cutting rotor, each arm thereof may bear discrete cutting elements secured thereon and include a cutting section 128 which is extendible and retractable in the radial direction. Each arm further includes a shovel-like component or scraping or ploughing means or a loading bucket or the like (not shown) for directing excavated material, preferably the shovel-like component or the like is extendible and retractable together with the cutting section 128. The two cutting heads 121 and 122 can be driven in mutually opposite rotation directions in a synchronized manner.

Although three-armed rotary cutting heads 121 and 122 are described, it should be understood that boring heads having other configurations could be utilized. Any configuration of rotary boring head such as a two-armed or single-armed boring head or the like, can be used.

The heading machine further includes a pair of cutting drums 120 and 123 each having a horizontal axis of rotation 124, 131 that is transverse to the longitudinal direction of the machine. The cutting drums are mounted respectively on drum support arms that are pivotable about a respective axis parallel to the axis of rotation of the cutting drums, driven by hydraulic cylinders, so that the cutting drums may be raised or lowered relative to the machine frame 114 or cutting boom respectively. Each cutting drum may include at each end an extendible end section 127 that is connected with the central portion of the cutting drum by the aid of a positive connection in a manner secured against rotation, yet displaceable in the direction of the axis of rotation of the cutting drum.

A plurality of cutting units are mounted on the cutting drums 120 and 123, spaced apart in a specific pattern. For example, on the circumference of the cutting drums it may be a spiral or series of spirals, or a helical pattern.

FIG. 1A further shows a hauling device 130, for example, a chain conveyor, which extends in the longitudinal direction of the machine beyond the end of the machine frame 114 for discharging the excavated material in the rear.

Figure 2A:
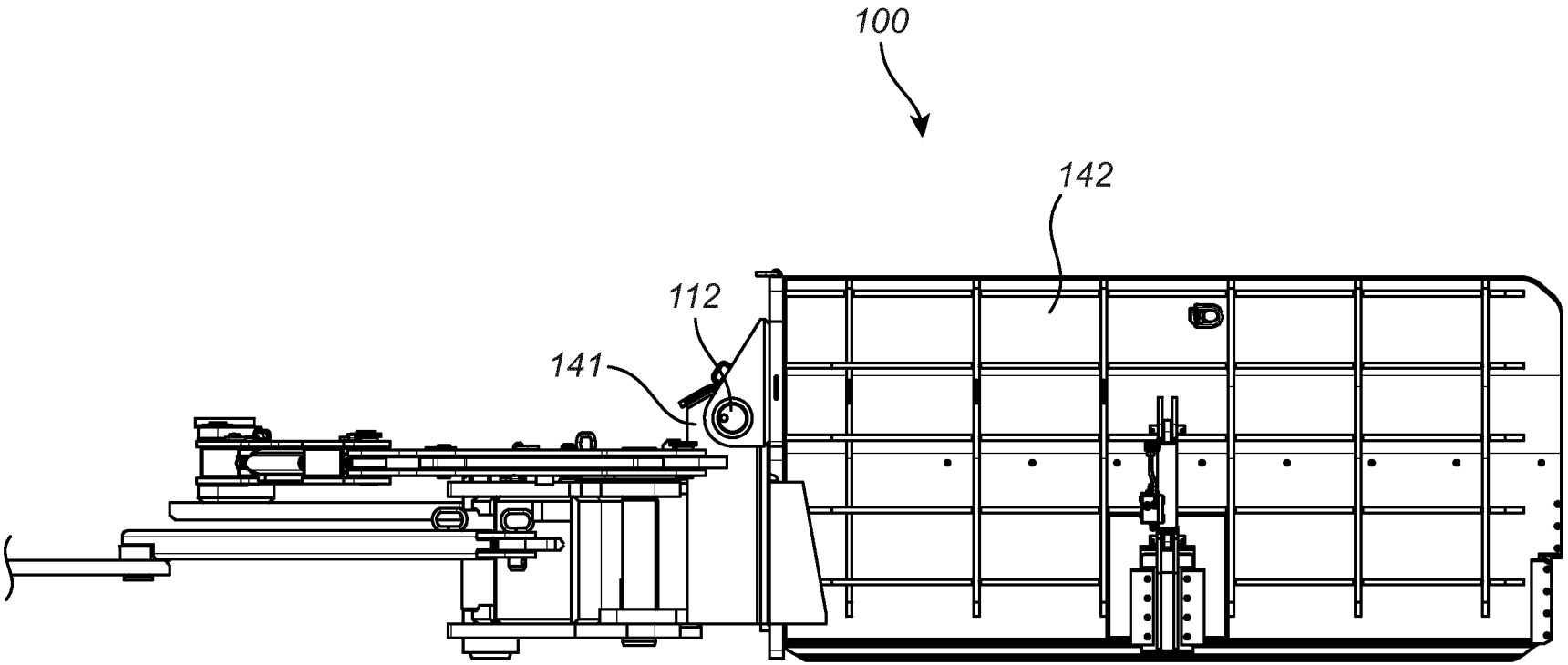
FIG. 2A is an elevation view of a material handling apparatus according to a specific implementation of the present invention.
Figure 2B:
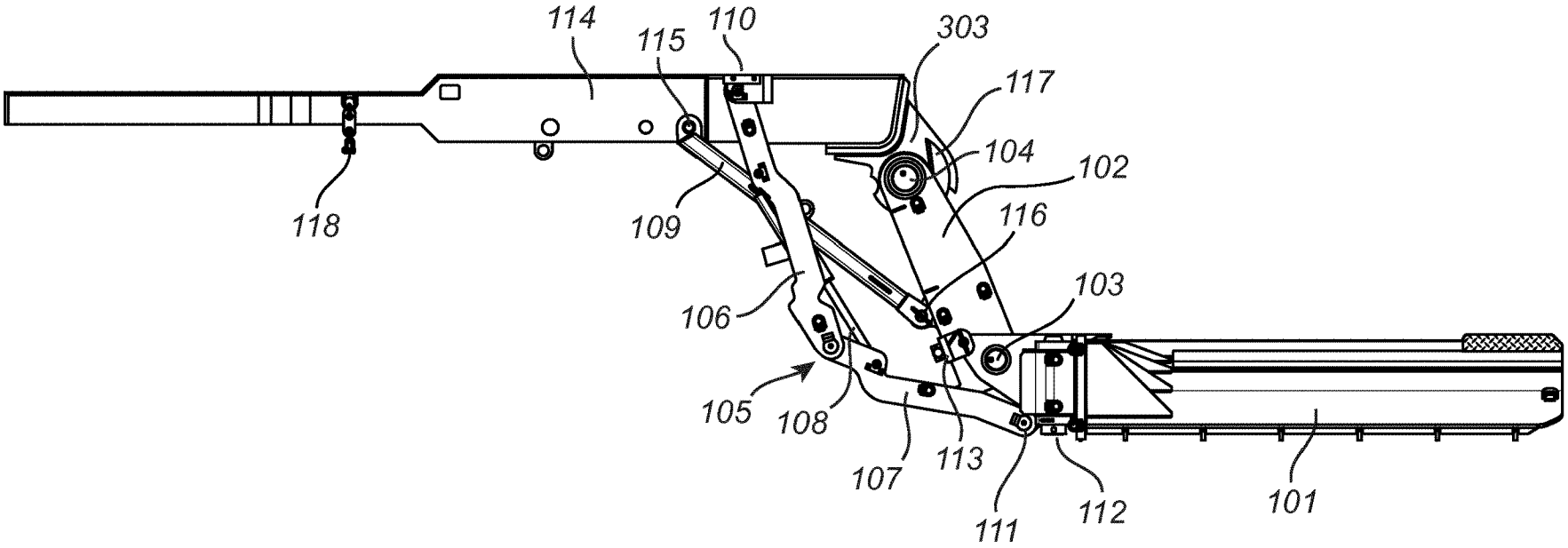
FIG. 2B is a plan view showing the material handling apparatus of FIG. 2*a;*

FIG. 2A shows an elevation plan view of a plough 100 according to one embodiment of the present invention, seen from the outer side of the machine. FIG. 2B is a plan view showing a plough of FIG. 2A. The plough 100 is found at its working position, which includes a material handling member 101 (referred to as mouldboard) mounted at a linkage member 102 via a first joint connection 103. The first joint connection 103 may be a pivot pin or hinge and the like, the mouldboard 101 includes at its proximal end a pin or bolt that can be inserted into a pin receptacle found at distal end of the linkage member 102. The linkage member 102 may be coupled to the machine frame 114 in a joint connection 104 similar to the first joint connection 103. The machine frame 114 may include an extension part 303 in the form of casting lug or stem having a pin or bolt that can be inserted into a pin receptacle found at proximal end of the linkage member 102.

The mouldboard 101 includes a bracket 141 and a conveying panel 142, the bracket 141 is mounted on the linkage member 102 via a pin connection 103, the panel 142 may be a rib-reinforced slab having rectangular form, and is vertically oriented or slightly tipped (tipped outwards at its working position, see FIG. 1B), it is pivotally mounted on bracket 141 via a pin connection 112 having horizontal axis of rotation, the lower part of the panel 142 rests against the bracket 141. The pin connection 112 allows the panel 142 to freely rollover counter-clockwise, when the panel 142 runs into a bump or slope on the ground.

A variety of holding means may be implemented in order to lock the mouldboard 101 in a fixed position. When the machine advances and pushes the excavated material forward, the plough 100 shall bear a counter force at its working position. This force may be largely absorbed by locking means such as a lever 109, a latch mechanism 301 and 305, and a lever system 105.

As a holding support, a lever 109 is added to help fix the linkage member 102 in place, its one end is to be secured on the machine frame 114 at a pivot point 115, the other end 116 is connected to the linkage member 102. In order to adapt to different working positions of the mouldboard 101, the lever is telescopic or adjustable in its length or simply replaced by a lever of other required length. It may include a slot to receive a pin of the linkage member 102 in slightly adjustable position. The lever 109 is to be mounted when the mouldboard 101 reaches its working position, and detached before the mouldboard 101 returns to its parking position.

Figure 6:
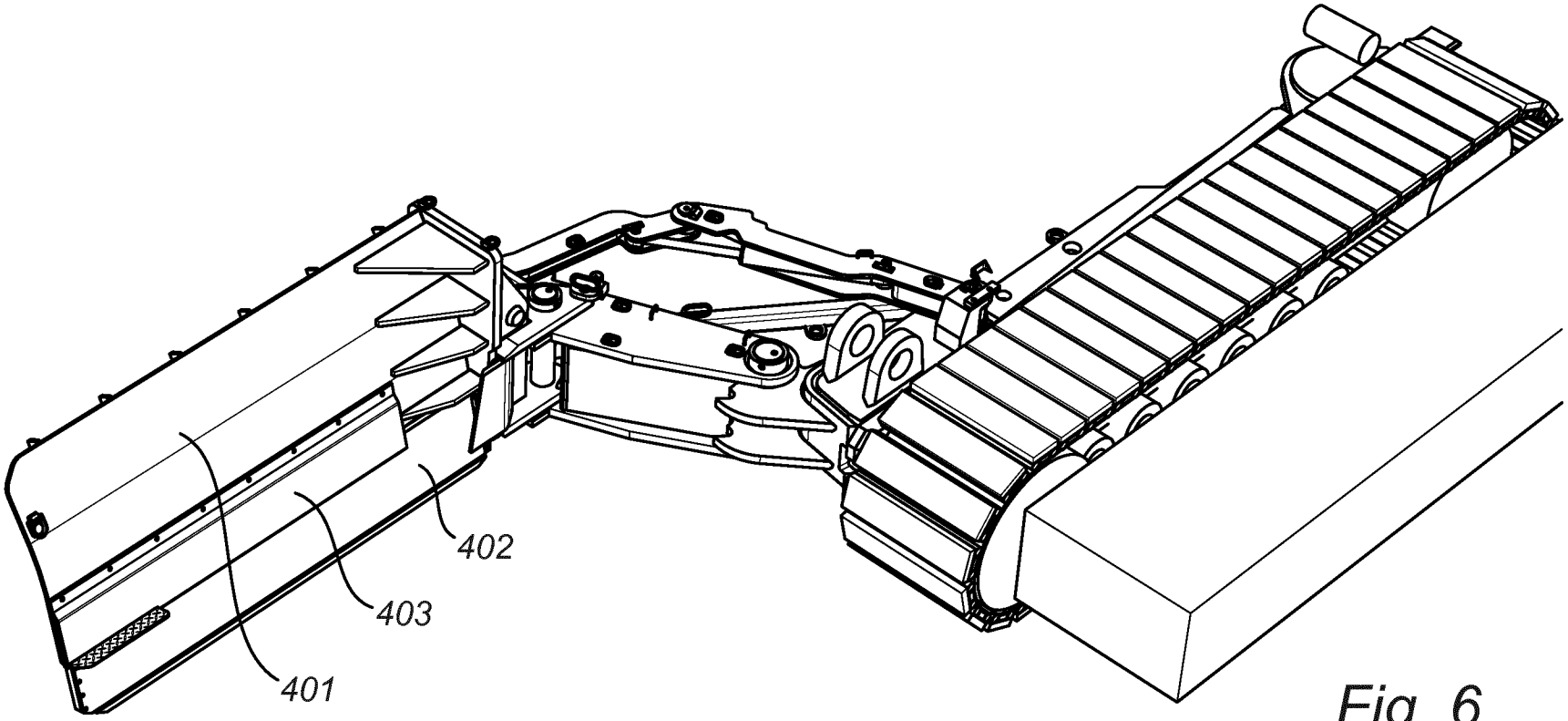
FIG. 6 is a perspective view of a material handling apparatus according to a specific implementation of the present invention, seen from inner side of the machine.

A lever system 105 may be implemented for holding the mouldboard 101. It includes a first arm 106 and a second arm 107 hinged together in a head-tail manner to build a deformable V-shaped structure. The proximal end of the first arm 106 is pivotably secured onto the machine frame 114 at a vertical pivot point 110. The distal end of the second arm 107 is pivotably connected to the mouldboard 101 at a pivot point 111. Further, a hydraulic cylinder 108 is arranged for fixing and maintaining the V-shaped structure. Its one end is pivotably connected to the second arm 107 at an intermediate position, the other end is pivotably connected to the first arm 106 or at the pivot point 110. For the holding function, the cylinder 108 needs to be pressurized, for example to be maintained at a constant pressure. The cylinder 108 may be 'embedded' within the opening spaces of the first and second arms 106, 107 (FIG. 6, FIG. 2A).

The location of the set of pivot points 110 and 111 and 103 may be chosen such that at the working position the first pivot connection 103 is spaced apart from a line connecting both ends 110 and 111 of the lever system 105. The first pivot connection 103 is located at the same side as the material collecting member 101 in relation to the line. This allows the mouldboard 101 to swing outwards upon retraction of the cylinder 108.

Figure 4:
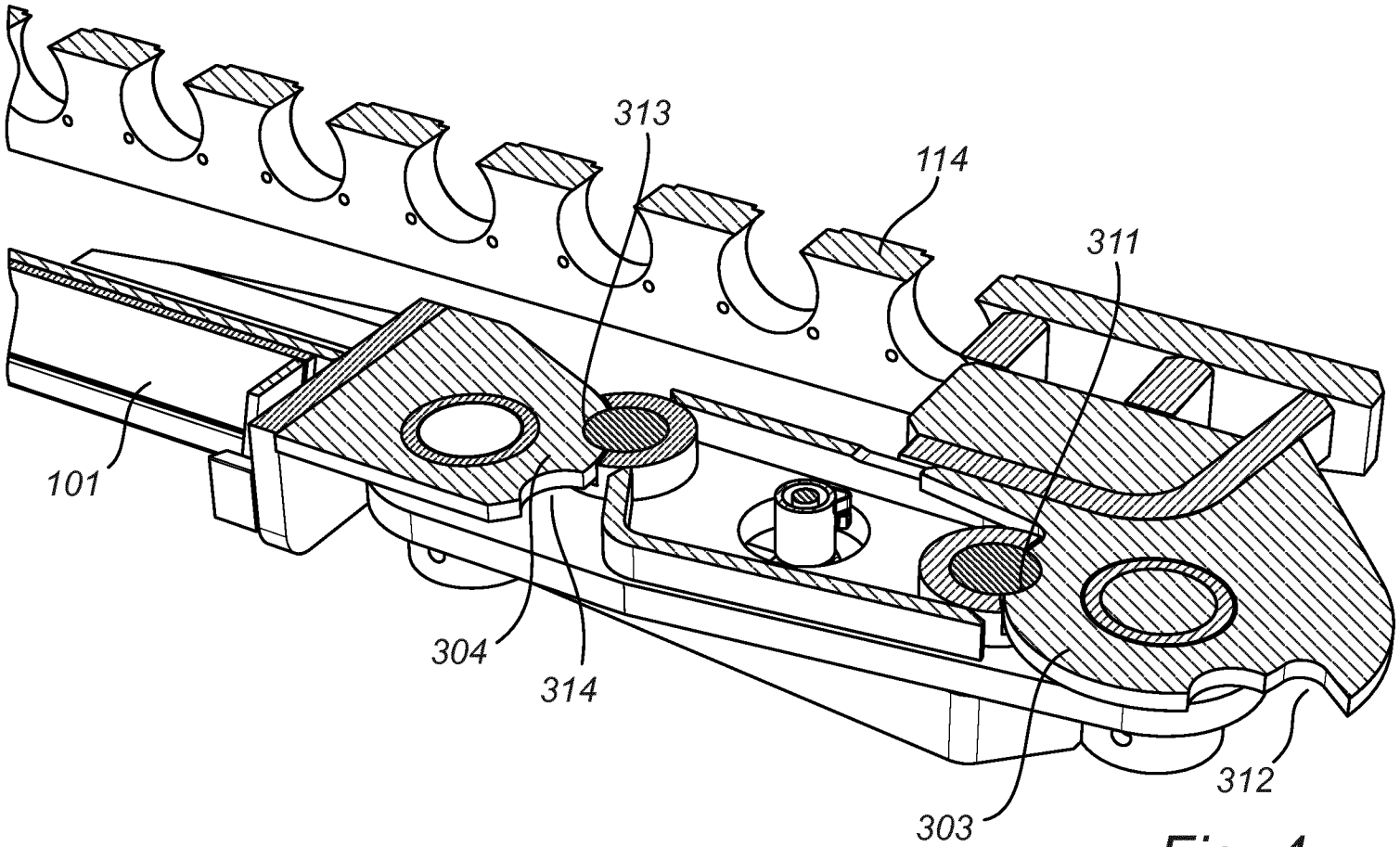
FIG. 4 is a partial perspective view showing a cross section of a material handling apparatus at its parking position.
Figure 5:
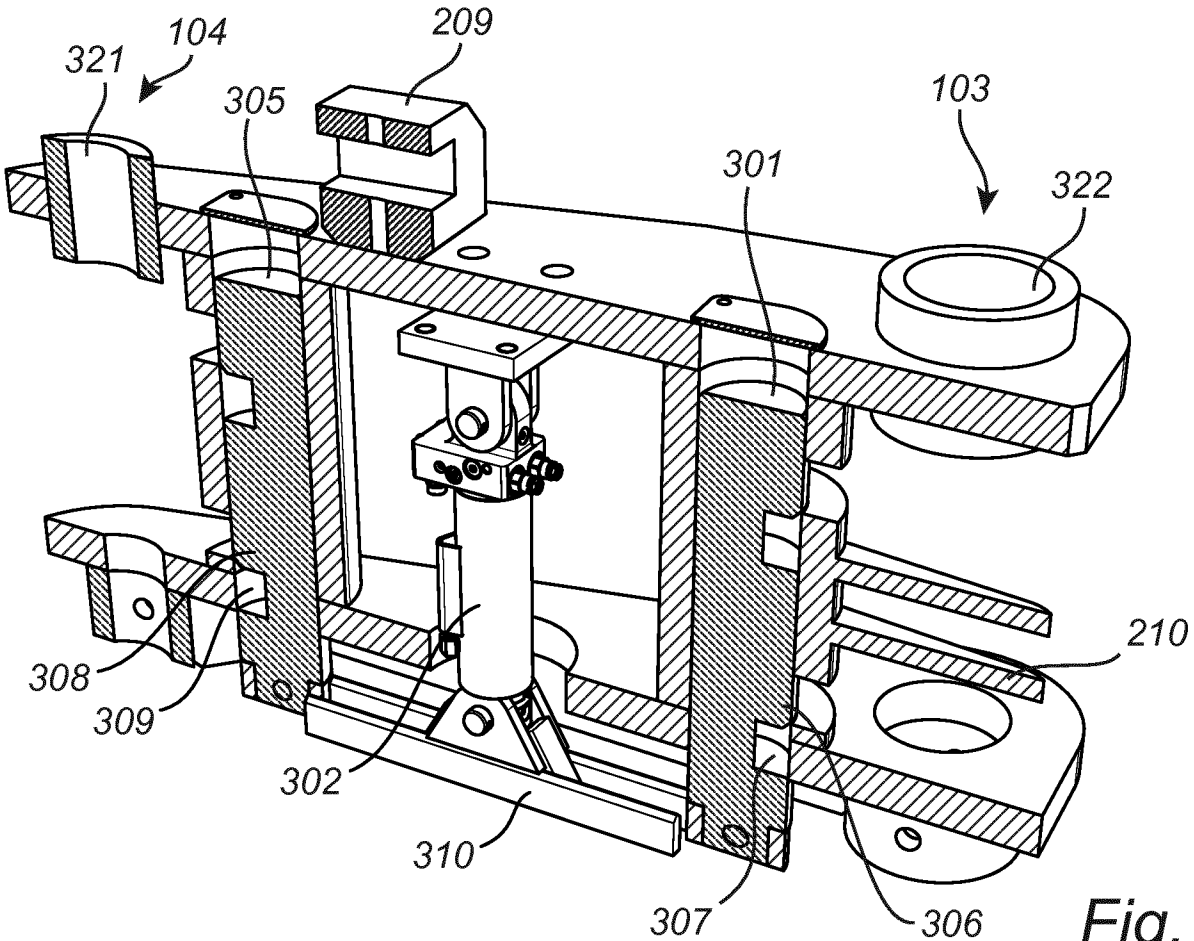
FIG. 5 is a perspective view showing a cross section of a linkage member.

A latch mechanism 301, as well as latch mechanism 304 and 305 are illustrated in FIGS. 4 and 5.

FIG. 4 is a partial perspective view showing a horizontal cross section of a plough at its parking position. FIG. 5 is a perspective view showing a vertical cross section of a linkage member. The machine frame 114 includes an extension part or seat or lug 303 having a pin or bolt that can be inserted into a pin receptacle 321 found at a proximal end of the linkage member 102. The extension part 303 has locally a substantial circular circumference that is co-axial with the joint connection 104, the extension part 303 has a set of recesses 311, 312 on the circular circumference. The bracket 141 has an extension part 304 that is co-axially rotatable about the joint connection 103. The extension part 304 having locally a substantial circular circumference where the extension part 304 has a set of recess 313, 314.

Turning to the linkage member 102, its proximal end includes a pair of pin receptacles 321 that is capable of receiving a pin or bolt to form a hinge connection with the extension part 303. Similarly, its distal end includes a pair of pin receptacles 322 that is capable of receiving a pin from the bracket 141 to form the joint connection 103.

A pair of parallel latch beams, also referred to as movable members 301 and 305 are part of the locking assembly are movably or slidably incorporated into the linkage member 102, with a set of recesses 307 and 309 thereon. The parallel latch beams are connected to a common connection beam 310 that is displaceable vertically between a set of positions, actuated by a hydraulic cylinder 302. The cylinder 302 is integrated in the linkage member 102, and is coupled to the middle of the connection beam 310.

When aligned with the extension part 303, the recess 309 allows the extension part 303 to freely pass through, thus permitting the linkage member 102 to freely rotate about the joint connection 104 during relocation of the mouldboard 101. When the linkage member 102 situates at the parking position or a working position, the recess 311, 312 permits the latch beam 305 to freely move downwards, until a protrusion 308 on the latch beam 305 engages complementarily with the recess., Thereby the rotation of the linkage member 102 about the joint connection 104 is hindered.

Similar holding means is present between the mouldboard 101 and the linkage member 102. The recess 307 on the latch beam 301 may allow the extension part 304 of the mouldboard 101 to freely pass through, thus permitting the mouldboard 101 to freely rotate about the joint connection 103 at the parking position or at a working position. The recess 313, 314 permits the latch beam 301 to freely move downwards, until a protrusion 306 on the latch beam 301 engages complementarily with the recess 313, 314, thereby to prevent the relative rotation between the mouldboard 101 and the linkage member 102 about the joint connection 103.

A locking assembly comprising a locking catch 113 (FIG. 2B) and the movable members 301, 305. The locking assembly may be employed for cooperating with a connector on the tip of the mouldboard 101, so as to secure the mouldboard 101 fixed against the linkage member 102, when reaching a working position. A stopper 117 is added on the machine frame 114 for abutting against the linkage member 102 to limit its further rotation.

To cope with different cutting profile widths, a further system of holding means can be easily implemented or adapted based on a second working position, for example, by choosing a telescopic lever 109 or simply using a lever having another length, or ensuring the hydraulic cylinder 108 to have enough stroke length, or providing additional recess on the extension part 303 of the machine frame and on the extension part 304 of the mouldboard 101. The locking catch 113 and stopper 117 is adjustable or movable in position, or an additional one can be added.

Additionally, a fastener 118 on the machine frame 114 may securely fix the mouldboard at the parking position.

In the above illustrated embodiments, the extension part 303 is described as a part of the machine frame 114, however it can be implemented as a part of the linkage member 102. In this case, the extension part 303 is firmly mounted on the machine frame 114 and includes or carries the second joint connection 104, the remaining part of the linkage member 102 is journaled or pivotably coupled on the extension part 303 about the second joint connection 104.

A lever system 105 including the telescopic lever 109 and a first and second cylinder 205, 206 may be used for driving the mouldboard 101, in addition to its usage as a holding means. The hydraulic cylinder 108 serves for opening and closing the V-shaped structure, when the mouldboard 101 is at the parking position the V-shaped structure is in its closed state, the cylinder 108 is non-pressurized; once the cylinder 108 is pressurized under the control of a hydraulic circuit e.g. having a solenoid valve, it opens the V-shaped structure, until the mouldboard 101 reaches a working position.

Figure 3:
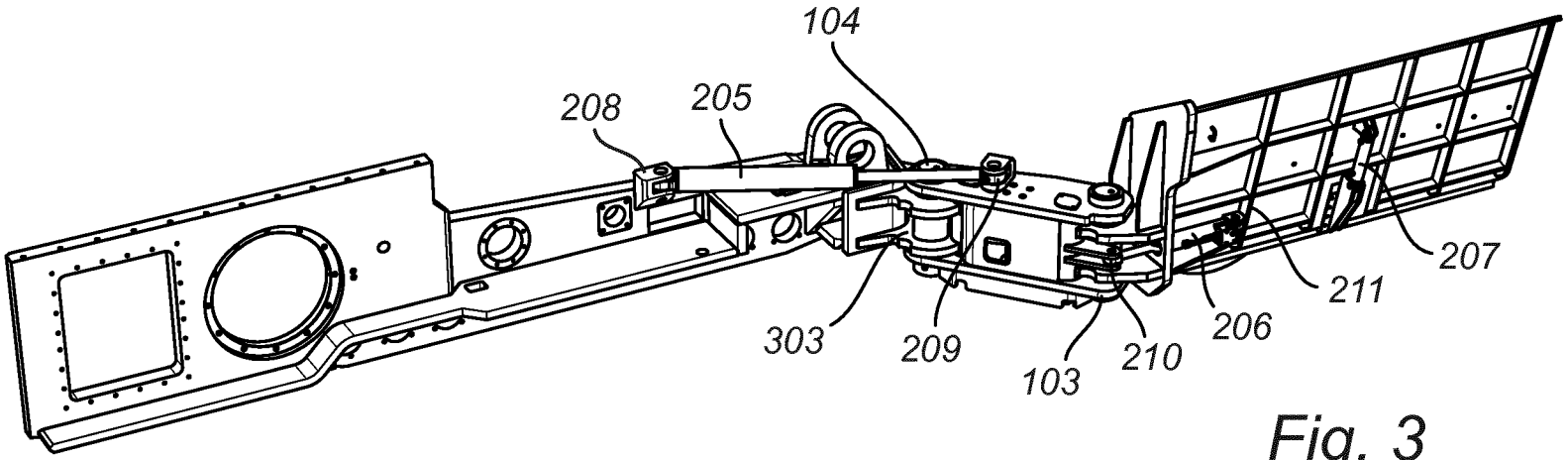
FIG. 3 is a perspective view of a material handling apparatus according to a further specific implementation of the present invention.

Referring to FIG. 6, the setup of the mouldboard 101 is shown, the conveying panel 142 includes an upper slab 401 and a lower slab 402 that is vertically slidably coupled on the upper slab 401, the slide movement is guided by a cover board 403, with the aid of a hydraulic cylinder 207 (see FIG. 3). The cylinder 207 is mounted on the opposite side of the panel 142 and oriented substantially upright, it interconnects the lower slab 402 to the upper slab 401.

FIG. 3 shows a plough according to a further specific implementation of the present invention. The mouldboard 101 and the linkage member 102 have similar structure as the preceding embodiment as illustrated based on FIG. 2A and FIG. 2B. The plough 100 includes a first hydraulic cylinder 205 pivotably coupled between a pivot point 208 on the machine frame 114 and an intermediate connector 209 of the linkage member 102, the cylinder 205 is operable as a drive means to swivel the linkage member 102, also as a holding means to lock swivel the linkage member 102 upon being pressurized.

The plough 100 further includes a second hydraulic cylinder 206 pivotably coupled between a pivot lug 210 of the linkage member 102 and a rib 211 of the mouldboard 101 that is remote from the lug 210. This cylinder 206 is operable as a drive means to adjust the position of the handling member 101 relative to the linkage member 102. The cylinder also serves as a holding means to lock the handling member 101 relative to the linkage member 102 at a working position upon being pressurized. The first and the second cylinder 205 and 206 are part of the lever system.

Figure 1B:
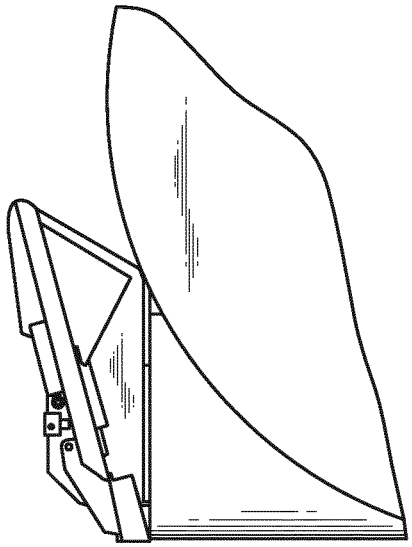
FIG. 1B is a partial front view of a heading machine equipped with a material handling apparatus according to a specific implementation of the present invention.
Figure 1C:
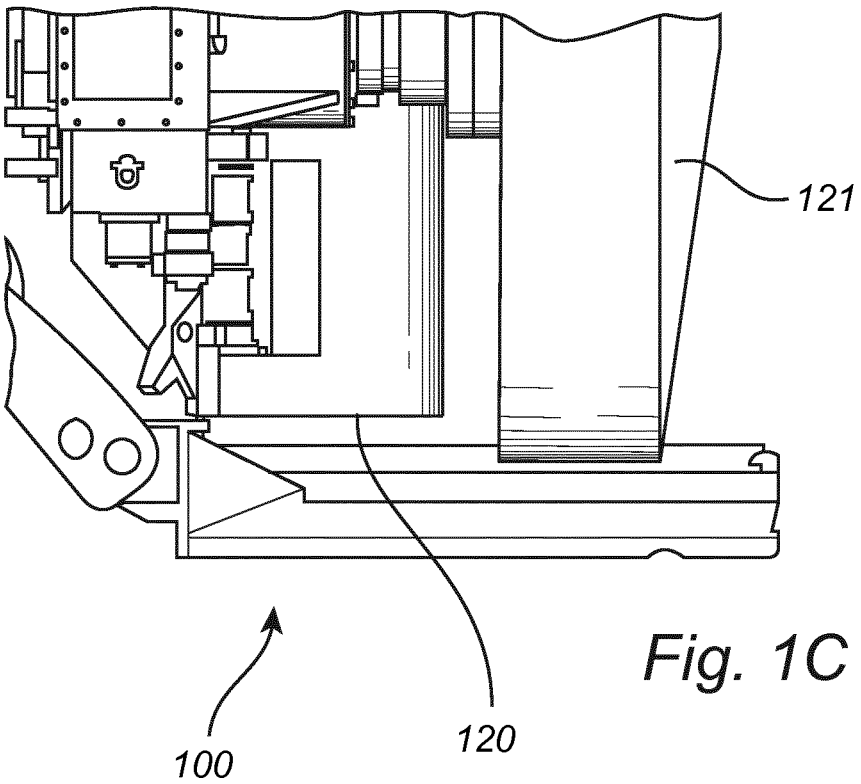
FIG. 1C is a partial top view of a heading machine equipped with a material handling apparatus according to a specific implementation of the present invention.

FIG. 1B depicts a partial front view of the plough of the heading machine that has been extended to its working position. FIG. 1C is a corresponding partial top view of a heading machine of FIG. 1B where the reference number 121 in this figure indicates a trace of a cutting rotor. The plough 100 is positioned substantially parallel to the machine longitudinal direction, situated on one side of and substantially close to the cutting tool system, leaving less free space between the conveying panel 101 and the bottom drum 120, the mouldboard extends forward about 500 mm beyond the cutting rotor and is configured to slightly tip or tilt outwardly, these help collect and guide the material cut-off by the cutting rotor 121, the top and bottom cutting drums.

For a first cutting pass, the plough 100 is in its retracted state and rests at its parking position, it shall not protrude beyond the cutting profile, even a narrowest one. When a second cutting pass, niche cutting, cross cutting is about to be performed, the drive means 105 is actuated to swivel the mouldboard 101 around 180 degree to the front area of the machine to reach a working position.

In the case of cutting a narrower profile, the linkage member 102 moves to a working position forming a smaller acute angle in relation to the machine longitudinal direction, the mouldboard 101 is still substantially aligned with and parallel to th machine longitudinal direction and held in place by corresponding holding means. This is depending on the required cutting profile width, the mouldboard 101 can be positioned at different adjustable working positions and be locked in place. A similar size of free space between the conveying panel 101 and the bottom drum 120 is however maintained, preferably kept at a minimal.

When the heading machine advances, i.e. during cutting operation, excavated material falling on the ground may stack and gather within the region between the plough 100 and the cutting tool system, the material is drawn close and forced forward by the moving machine. A plurality of inwardly-tilted cutting tools arranged on the rotor arm can transfer excavated material towards the central area of the machine. In addition, the rotating rotor arm (rotation direction see FIG. 1A) including a shovel-like means or scraping or ploughing means to direct or sweep excavated material towards the central area of the machine. Simultaneously, along with the rotation of the bottom cutting drum (rotating in counter-clockwise direction, seen from the side of the plough, FIG. 1A), a plurality of upwardly and inwardly tilted cutting tools arranged in spiral pattern on the circumference of the drum help bring excavated material towards the central area of the machine, on the other hand overturn the material gathered in the central area to the central belt conveyor.

The heading machine can be used in the mining industry for cutting mines and tunnels, especially for application in a potash mine or a salt mine.

The invention claimed is:

1. An apparatus for handling excavated material, the apparatus comprising:

a material handling member arranged to gather excavated material, wherein the apparatus is coupled to a machine frame;

a linkage member, the material handling member being coupled to the linkage member at a distal end thereof by a first joint connection, the linkage member at its proximal end having at least a part of a joint arrangement to form a second joint connection with the machine frame; and a locking means arranged to prevent a movement of the material handling member at a working position in relation to the machine frame, the locking means being configured to be coupled between the material handling member and the machine frame, or between the linkage member and the machine frame, or between the material handling member and the linkage member;

at least one drive means arranged for actuating a movement of the material handling member in a horizontal plane between a parking position and a working position, wherein the at least one drive means includes a first and a second arm pivotably attached together at one end of each arm, the other end of the second arm is pivotably coupled to the material handling member, the other end of the first arm being configured to be pivotably coupled to the machine frame at a base position departing from the second joint connection, the at least one drive means including an actuator arranged between the first and second arms for providing an angular displacement therebetween.

2. The apparatus as claimed in claim 1, wherein the locking means includes a locking assembly arranged on the linkage member, and/or a locking mechanism on the material handling member, and/or a lever system.

3. The apparatus as claimed in claim 1, wherein each of the first joint connection and the second joint connection is a pin pivot or hinge having a vertical axis of rotation.

4. The apparatus as claimed in claim 1, wherein the actuator includes a hydraulic cylinder having one end pivotably attached to an intermediate point of the second arm and another end pivotably attached to the first arm.

5. The apparatus as claimed in claim 1, wherein the at least one drive means includes a first hydraulic cylinder, wherein one end of the first hydraulic cylinder is pivotably coupled to the linkage member at a position departing away from the second joint connection, the other end being pivotably connected to the machine frame at a base position departing from the second joint connection, the at least one drive means further including a second hydraulic cylinder having one end pivotably coupled to the distal end of the linkage member and another end being pivotably coupled to the material handling member at a position remote from the first joint connection.

6. The apparatus as claimed in claim 1, wherein the material handling member includes a bracket and a conveying panel, the conveying panel being pivotably attached to the bracket via a pivot connection having a horizontal axis of rotation, wherein the bracket is coupled to the linkage member by a pivot connection having a vertical axis of rotation.

7. The apparatus as claimed in claim 6, wherein the conveying panel includes an upper part and a lower part that is movably coupled to the upper part, and an actuation means arranged to lift and lower the lower part relative to the upper part.

8. The apparatus as claimed in claim 1, wherein the locking means includes a movable member arranged for locking the linkage member at the parking position or at the working position, the movable member being spaced apart from the second joint connection, and having a counterpart arranged to engage with a complementary part of an extension of the machine frame such that a rotation movement of the linkage member is prevented.

9. The apparatus as claimed in claim 1, wherein the locking means includes a movable member arranged for locking the material handling member relative to the linkage member at the parking position or at the working position, the movable member being spaced apart from the first joint connection and having a counterpart arranged to engage with a complementary part on an extension of the linkage member such that a rotation movement of the material handling member relative to the linkage member is prevented.

10. A mining machine comprising:

a machine frame and a cutting tool system mounted on the frame; and an apparatus according to claim 1, wherein the apparatus is coupled to the machine frame such that, when positioned at a working position, the material handling member is situated on one side of and close to the cutting tool system.

11. A mining machine as claimed in claim 10, wherein the cutting tool system includes a bottom cutting drum having a transverse horizontal axis of rotation, the cutting drum including a plurality of cutting tools arranged tilted upwardly and/or inwardly and/or in a spiral pattern on the circumference.

12. A mining machine as claimed in claim 10, wherein the cutting tool system includes at least one cutting rotor having a longitudinal horizontal axis of rotation, each at least one cutting rotor having at least one rotor arm.

* * * * *